US006800595B2

(12) United States Patent
Ozaki et al.

(10) Patent No.: US 6,800,595 B2
(45) Date of Patent: Oct. 5, 2004

(54) GREASE COMPOSITION WITH IMPROVED RUST PREVENTION AND ABRASION RESISTANCE PROPERTIES

(75) Inventors: Takahiro Ozaki, Tokyo (JP); Noriaki Shinoda, Tokyo (JP); Kouichi Nakazawa, Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/344,494

(22) PCT Filed: Aug. 10, 2001

(86) PCT No.: PCT/EP01/09347

§ 371 (c)(1),
(2), (4) Date: Feb. 10, 2003

(87) PCT Pub. No.: WO02/12418

PCT Pub. Date: Feb. 14, 2002

(65) Prior Publication Data

US 2003/0176295 A1 Sep. 18, 2003

(30) Foreign Application Priority Data

Aug. 10, 2000 (JP) ..... 2000-242911

(51) Int. Cl.[7] ..... C10M 141/00; C10M 125/22

(52) U.S. Cl. ..... 508/154; 508/280; 508/281; 508/390; 508/518; 508/519; 508/554; 508/586

(58) Field of Search ..... 508/154

(56) References Cited

U.S. PATENT DOCUMENTS

| | | | | |
|---|---|---|---|---|
| 3,505,223 A | | 4/1970 | Niebylski | |
| 4,923,625 A | | 5/1990 | King | |
| 5,589,444 A | * | 12/1996 | Hatakeyama | 508/168 |
| 5,607,906 A | * | 3/1997 | Okaniwa et al. | 508/168 |
| 6,037,314 A | * | 3/2000 | Kondo et al. | 508/363 |
| 6,136,762 A | * | 10/2000 | Yoshinari et al. | 508/552 |

FOREIGN PATENT DOCUMENTS

| | | | |
|---|---|---|---|
| EP | 0 042 626 | 4/1991 | C10M/125/00 |
| JP | 1135965 | 5/1989 | F16J/15/14 |
| JP | 2000239685 | 9/2000 | C10M/117/04 |
| WO | 92/19703 | 11/1992 | C10M/163/00 |
| WO | 99/05240 | 2/1999 | C10M/169/06 |

* cited by examiner

*Primary Examiner*—Ellen M. McAvoy

(57) ABSTRACT

A grease composition having a base oil and a thickener, which grease additionally has from 0.05% to 30% by weight of sodium thiosulphate and at least 0.1% by weight of one or more additives selected from the group of: calcium salicylate, magnesium salicylate, calcium phenate, and calcium sulphonate, based on the total grease composition, and use of the grease composition to improve rust prevention and abrasion resistance. The invention also relates to a method for preparing the grease composition.

9 Claims, No Drawings

GREASE COMPOSITION WITH IMPROVED RUST PREVENTION AND ABRASION RESISTANCE PROPERTIES

FIELD OF THE INVENTION

The present invention relates to a grease composition which has improved rust prevention and abrasion resistance properties.

BACKGROUND OF THE INVENTION

Extreme pressure greases have many uses, because of their excellent abrasion resistance and their ability to withstand loads, for example in bearings and gears in the automobile, iron and steel, railway, and various other, industrial mechanical devices.

Typical extreme pressure grease compositions are in general those which contain, in various types of grease, additives such as olefin sulphides, sulphides of fats and oils, sulphur-phosphorus-based extreme pressure agents, molybdenum disulphide, organomolybdenum compounds, lead compounds and zinc dithiophosphate.

Recent art has disclosed grease compositions containing sodium thiosulphate, which have excellent extreme pressure properties: in the Specifications of Japanese Laid-open Patent 3-131690, Japanese Laid-open Patent 11-35965 and U.S. Pat. No. 4,923,625.

However, the abrasion resistance in these prior art documents is unsatisfactory and there is the further possibility that rusting will be induced because sodium thiosulphate has the property of absorbing moisture. In particular, since bearings and gears of steel equipment and foodstuff machinery are lubricated under conditions where there are large quantities of water, the production of rust is promoted and problems with respect to lubrication are readily produced.

It is therefore highly desirable to be able to provide grease compositions in which the extreme pressure properties of grease compositions which contain sodium thiosulphate are retained well, whilst the production of rust is inhibited and abrasion resistance is also improved.

SUMMARY OF THE INVENTION

The present invention provides a grease composition comprising a base oil and a thickener, which grease additionally comprises from 0.05% to 30% by weight of sodium thiosulphate and at least 0.1% by weight of one or more additives selected from the group of: calcium salicylate, magnesium salicylate, calcium phenate and/or calcium sulphonate, based on the total grease composition.

DETAILED DESCRIPTION OF THE INVENTION

In a preferred embodiment, the grease composition of the present invention further comprises at least 0.1% by weight of a benzotriazole compound (B), based on the total grease composition.

In the grease compositions according to the present invention, the thickener may be agents such as urea compounds, lithium soaps, lithium complex soaps and aluminium complex soaps, which may be used singly or as mixtures. In addition to compounds having urea bonds, the urea compounds may naturally be compounds containing both urea bonds and urethane bonds. Diurea, triurea and/or tetraurea thickener may be conveniently used. Urea-imido compounds may also be conveniently employed as thickeners.

In a preferred embodiment of the present invention, from 2 to 35% by weight of thickener is used, based on the total grease composition.

The base oils used according to the invention may employ vegetable oils; mineral oils; and synthetic oils, such as ester oils, ether oils and hydrocarbon oils.

The sodium thiosulphate used according to the invention may be $Na_2S_2O_3$ (anhydrous) or $Na_2S_2O_3.5H_2O$ (the pentahydrate), or mixtures of these. Commercial additives containing sodium thiosulphate may also be used (for example, Desilube 88, Desilube Technology Incorporated, USA).

The amount of sodium thiosulphate added is preferably in the range of from 0.2% to 20% by weight, more preferably in the range of from 0.2% to 10% by weight, more preferably in the range of from 0.2% to 8% by weight and most preferably in the range of from 0.5% to 6% by weight, based on the total grease composition.

Preferably, the one or more additives selected from the group of: calcium salicylate, magnesium salicylate, calcium phenate and/or calcium sulphonate are each present in an amount in the range of from 0.1% to 5% by weight, more preferably in the range of from 0.2% to 3% by weight, based on the total grease composition.

The benzotriazole compound (B) is preferably present in an amount in the range of from 0.1% to 5% by weight, more preferably in the range of from 0.2% to 3% by weight, based on the total grease composition.

When there is less than 0.1% by weight of the aforementioned additive (A), the rust prevention effect is inadequate and, when there is less than 0.1% by weight of the aforementioned additive (B), the abrasion resistance promoting effect is inadequate.

When there is more than 5% by weight of either additive, there is limited or no further increase in their effects.

Examples of the aforementioned benzotriazoles (B) include 1,2,3-benzotriazole, 2-(2'-hydroxy-5'-methylphenyl) benzotriazole, 2-[2'-hydroxy-3'-(3",4",5",6"-tetrahydrophthalimidomethyl)-5'-methylphenyl] benzotriazole, 2-(2'-hydroxy-3',5'-di-tertiary-butylphenyl) benzotriazole, 2-(2'-hydroxy-5'-tertiary-octylphenyl) benzotriazole, 2-(2'-hydroxy-3',5'-di-tertiary-amylphenyl) benzotriazole, 2-[2-hydroxy-3,5-bis(α,α-dimethylbenzyl) phenyl]-2H-benzotriazole and 2-(2'-hydroxy-3'-undecyl-5-methylphenyl)benzotriazole.

The grease composition of the present invention may further comprise additional additives, for example, antioxidants, such as amines and phenols; extreme pressure additives, such as olefin sulphides and fat and oil sulphides; extreme pressure/abrasion resistance agents, such as phosphites and phosphates; thickeners, such as polybutenes and polymethacrylates; solid lubricants, such as boron nitride and molybdenum disulphide; and various other additives.

Grease compositions according to the present invention may be prepared either by pre-mixing the sodium thiosulphate, one or more additives (A) selected from the group comprising calcium salicylate, magnesium salicylate, calcium phenate and/or calcium sulphonate and any further additives to be incorporated in base oil and adding the mixture to a base grease comprising base oil and thickener, or by incorporating each additive into the base grease individually. This may be achieved via hot or cold mixing followed by homogenisation to ensure uniform dispersion of additive components.

The grease composition of the present invention may be conveniently employed in bearings, gears and joints such as constant velocity joints.

The invention will now be described with reference to the following Examples, which are not intended to limit the scope of the present invention in any way.

EXAMPLES

Preparation of Grease Compositions

The Example and Comparative Example greases were obtained according to the formulations given in Tables 1 to 9 by adding the additives corresponding to the aforementioned (A) and (B), or other additives, to the base greases and treating these with a three-roll mill. The compositions of the base greases are given below.

I. Urea Base Grease

Diphenylmethane-4,4'-diisocyanate (295.2 g) and octylamine (304.8 g) were reacted in purified mineral oil (kinematic viscosity, approximately 15 $mm^2/s$ at 100° C.; 5400 g); the urea compound obtained was dispersed uniformly, so that a urea base grease of consistency 289 (at 25° C., 60W) and dropping point 263° C. was obtained. The urea compound content was 10% by weight.

II. Lithium Soap Base Grease

A lithium soap base grease of consistency 268 (at 25° C., 60W) and dropping point 199° C. was obtained by dispersing lithium 12-hydroxystearate (600 g) uniformly, by dissolving it, in purified mineral oil (kinematic viscosity, approximately 15 $mm^2/s$ at 100° C.; 5400 g). The lithium soap content was 10% by weight.

III. Lithium Complex Soap Base Grease

12-Hydroxystearic acid (350 g) and lithium hydroxide (50.5 g) were reacted in a purified mineral oil (kinematic viscosity, approximately 11 $mm^2/s$ at 100° C.; 4165 g), after which a compound lithium soap base grease of consistency 281 (at 25° C., 60 W) and dropping point 259° C. was obtained by reacting azelaic acid (120.65 g) and lithium hydroxide (59.0 g) and by uniform dispersion treatment. The lithium complex soap content was 10.4% by weight.

IV. Aluminium Complex Soap Base Grease

Benzoic acid (158.22 g) and stearic acid (334.8 g) were dissolved in purified mineral oil (kinematic viscosity, approximately 11 $mm^2/s$ at 100° C.; 4272 g), after which a compound aluminium soap base grease of consistency 279 (at 25° C., 60W) and dropping point 258° C. was obtained by carrying out a reaction by adding commercial cyclic aluminium oxide propylate lubricating fluid [Trade Name: *Arugoma* (Algomer), manufactured by Sengen Fain Kemikaru (Sengen Fine Chemicals) K.K.]; the soap produced was treated to uniformly disperse it. The aluminium complex soap content was made 11% by weight. The molar ratio of the benzoic acid (BA) and the stearic acid (FA) was taken as BA/FA=1.1:1 and the molar ratio of the benzoic acid plus stearic acid to the aluminium was taken as (BA+FA)/Al=1.9:1.

The rust prevention, extreme pressure and abrasion properties were ascertained by carrying out rust prevention tests (humidity tests) and four-ball tests (EP tests and abrasion resistance tests).

Humidity Tests

Samples of the greases were uniformly coated onto the whole surface of test pieces, in such a way that the amount of the grease coated onto the surface of a test piece was 0.30 g±0.05 g, as prescribed according to JIS (Japanese Industrial Standard) K2220 5.17 humidity tests. The steel plates to which a grease had been applied were suspended in a humidity cabinet at a temperature of 49° C. and a relative humidity of at least 95% and the degree of rusting after 2 weeks was expressed as a JIS K2246 grading.

| Grade | % Rust produced |
|---|---|
| Grade A | 0 |
| Grade B | 1 to 10 |
| Grade C | 11 to 25 |
| Grade D | 26 to 50 |
| Grade E | 51 to 100 |

EP Tests

Expansion loads (N) were tested by four-ball tests according to ASTM (American Society for Testing Materials) D2596.

| Test Conditions: | |
|---|---|
| Rate of rotation: | 1770 ± 60 rpm |
| Temperature: | 27° ± 8° C. |
| Time: | 10 ± 0.2 s |

Abrasion Resistance Tests

The diameters of abrasion marks on the balls used in the four-ball tests were measured according to ASTM D2266.

| Test Conditions: | |
|---|---|
| Rate of rotation: | 1200 ± 50 rpm |
| Temperature: | 75° ± 1.7° C. |
| Load: | 40 ± 2 kgf (392 ± 2 N) |
| Time: | 60 ± 1 min |

Additives

In the Tables below, *1 to *10 are as follows:

Desilube 88, *1, is a Trade Name of Desilube Technology Incorporated, for an inorganic S-P additive containing sodium thiosulphate.

The products below correspond to the aforementioned additive (A) according to the invention.

SAP001, *2, is a Trade Name of Infineum Limited, for calcium salicylate.

SAP007, *3, is a Trade Name of Infineum Limited, for magnesium salicylate.

OLOA219, *4, is a Trade Name of Oronaito Japan (K.K), for calcium phenate.

NA-SUL 729, *5, is a Trade Name of King Industries Incorporated for calcium sulphonate.

The products below correspond to the aforementioned additive (B) according to the invention.

BT-120, *6, is a Trade Name of Shirokita‡ Kagaku (Shirokita Chemicals) (K.K.) for 1,2,3-benzotriazole.

The following are additives other than (A) and (B).

NA-SUL ZS, *7, is a Trade Name of King Industries Incorporated for zinc sulphonate.

Dailube Z-500, *8, is a Trade Name of Dainippon Inki Kagaku Kogyo (Dainippon Ink and Chemicals) (K.K), for zinc naphthenate diluted in mineral oil (5% of zinc metal).

NA-SUL SS, *9, is a Trade Name of King Industries Incorporated for sodium sulphonate.

NA-SUL 707, *10, is a Trade Name of King Industries Incorporated for lithium sulphonate.

TABLE 1

| Example | 1 | 2 | 3 | 4 | 5 | 6 | 7 | 8 | 9 | 10 |
|---|---|---|---|---|---|---|---|---|---|---|
| Composition, % by weight | | | | | | | | | | |
| Base Grease | | | | | | | | | | |
| Urea Grease | 95.0 | 95.0 | 95.0 | 95.0 | 95.0 | 95.0 | 95.0 | 95.0 | 95.0 | 95.0 |
| Additive | | | | | | | | | | |
| $Na_2S_2O_3$ | 3.0 | 3.0 | 3.0 | 3.0 | | | | | | |
| $Na_2S_2O_3.5H_2O$ | | | | | 3.0 | 3.0 | 3.0 | 3.0 | | |
| Desilube 88 *1 | | | | | | | | | 3.0 | 3.0 |
| SAP001 *2 | 2.0 | | | | 2.0 | | | | 2.0 | |
| SAP007 *3 | | 2.0 | | | | 2.0 | | | | 2.0 |
| OLOA219 *4 | | | 2.0 | | | | 2.0 | | | |
| NA-SUL 729 *5 | | | | 2.0 | | | | 2.0 | | |
| BT-120 *6 | | | | | | | | | | |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | A | A | A | A | A | A | A | A | A |
| Four-ball test | | | | | | | | | | |
| Expansion load, N | 7845 | 7845 | 7845 | 7845 | 6080 | 6080 | 6080 | 6080 | 7845 | 7845 |
| Abrasion mark diameter, mm | 0.71 | 0.71 | 0.63 | 0.71 | 0.71 | 0.71 | 0.58 | 0.68 | 0.70 | 0.69 |

TABLE 2

| Example | 11 | 12 | 13 | 14 | 15 | 16 | 17 | 18 | 19 | 20 |
|---|---|---|---|---|---|---|---|---|---|---|
| Composition, % by weight | | | | | | | | | | |
| Base Grease | | | | | | | | | | |
| Urea Grease | 95.0 | 95.0 | 93.0 | 93.0 | 94.5 | 94.5 | 94.5 | 92.5 | 93.0 | 93.0 |
| Additive | | | | | | | | | | |
| $Na_2S_2O_3$ | | | 3.0 | | 3.0 | | | 3.0 | 2.0 | |
| $Na_2S_2O_3.5H_2O$ | | | | 1.0 | | 3.0 | | | 1.0 | 2.0 |
| Desilube 88 *1 | 3.0 | 3.0 | | 2.0 | | | 3.0 | | | 1.0 |
| SAP001 *2 | | | 2.0 | 2.0 | 2.0 | | | 2.0 | 1.0 | |
| SAP007 *3 | | | | 2.0 | | 1.0 | | | 1.0 | 1.0 |
| OLOA219 *4 | 2.0 | | | | | 1.0 | 0.5 | | | 1.0 |
| NA-SUL 729 *5 | | 2.0 | 2.0 | | | | | 2.0 | | |
| BT-120 *6 | | | | | 0.5 | 0.5 | 2.0 | 0.5 | 2.0 | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | A | A | A | A | A | A | A | A | A |
| Four-ball test | | | | | | | | | | |
| Expansion load, N | 7845 | 7845 | 7845 | 7845 | 7845 | 6080 | 7845 | 7845 | 7845 | 7845 |
| Abrasion mark diameter, mm | 0.55 | 0.68 | 0.69 | 0.67 | 0.46 | 0.43 | 0.45 | 0.39 | 0.39 | 0.45 |

TABLE 3

| Example | 21 | 22 | 23 | 24 | 25 | 26 | 27 | 28 | 29 | 30 |
|---|---|---|---|---|---|---|---|---|---|---|
| Composition, % by weight | | | | | | | | | | |
| Base Grease | | | | | | | | | | |
| Lithium Soap | 95.0 | 95.0 | 93.0 | 93.0 | 94.5 | 93.0 | 93.0 | 93.0 | 93.0 | 93.0 |

TABLE 3-continued

| Example | 21 | 22 | 23 | 24 | 25 | 26 | 27 | 28 | 29 | 30 |
|---|---|---|---|---|---|---|---|---|---|---|
| Grease Additive | | | | | | | | | | |
| $Na_2S_2O_3$ | 2.0 | | 2.0 | | | 3.0 | 2.0 | 2.0 | | |
| $Na_2S_2O_3.5H_2O$ | 1.0 | | | 2.0 | | | 1.0 | 1.0 | | 2.0 |
| Desilube 88 *1 | | 3.0 | 1.0 | 1.0 | 3.0 | | | | 3.0 | 1.0 |
| SAP001 *2 | | | | | | 1.0 | 1.0 | | | |
| SAP007 *3 | 2.0 | | 2.0 | | 2.0 | | | 1.0 | | |
| OLOA219 *4 | | 2.0 | 2.0 | 2.0 | 0.5 | 1.0 | 1.0 | 1.0 | 2.0 | |
| NA-SUL 729 *5 | | | | 2.0 | | | | | | 2.0 |
| BT-120 *6 | | | | | | 2.0 | 2.0 | 2.0 | 2.0 | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | A | A | A | A | A | A | A | A | A |
| Four-ball test | | | | | | | | | | |
| Expansion load, N | 6080 | 6080 | 6080 | 6080 | 6080 | 6080 | 6080 | 6080 | 6080 | 6080 |
| Abrasion mark diameter, mm | 0.72 | 0.72 | 0.71 | 0.68 | 0.72 | 0.47 | 0.49 | 0.39 | 0.49 | 0.50 |

TABLE 4

| Example | 31 | 32 | 33 | 34 | 35 | 36 | 37 | 38 | 39 | 40 |
|---|---|---|---|---|---|---|---|---|---|---|
| Composition, % by weight | | | | | | | | | | |
| Base Grease | | | | | | | | | | |
| Lithium Complex Soap Grease | 95.0 | 95.0 | 95.0 | 94.0 | 95.0 | 93.0 | 93.0 | 93.0 | 94.0 | 94.0 |
| Additive | | | | | | | | | | |
| $Na_2S_2O_3$ | 3.0 | | | | | 3.0 | | | | |
| $Na_2S_2O_3.5H_2O$ | | 3.0 | | 3.0 | 1.0 | | 3.0 | | 3.0 | 1.0 |
| Desilube 88 *1 | | | 3.0 | | 2.0 | | | 3.0 | | 2.0 |
| SAP001 *2 | 2.0 | | | | | 2.0 | | | | 1.0 |
| SAP007 *3 | | 2.0 | | | | | 2.0 | | | |
| OLOA219 *4 | | | 2.0 | 1.0 | 1.0 | | | 2.0 | 1.0 | 1.0 |
| NA-SUL 729 *5 | | | | 2.0 | 1.0 | | | | | |
| BT-120 *6 | | | | | | 2.0 | 2.0 | 2.0 | 2.0 | 1.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | A | A | A | A | A | A | A | A | A |
| Four-ball test | | | | | | | | | | |
| Expansion load, N | 6080 | 4903 | 6080 | 4903 | 6080 | 6080 | 4903 | 6080 | 4903 | 6080 |
| Abrasion mark diameter, mm | 0.60 | 0.79 | 0.78 | 0.78 | 0.77 | 0.47 | 0.48 | 0.54 | 0.56 | 0.51 |

TABLE 5

| Example | 41 | 42 | 43 | 44 | 45 | 46 | 47 | 48 | 49 | 50 |
|---|---|---|---|---|---|---|---|---|---|---|
| Composition, % by weight | | | | | | | | | | |
| Base Grease | | | | | | | | | | |
| Aluminium Complex Soap Grease | 93.0 | 93.0 | 93.0 | 93.0 | 93.0 | 93.0 | 93.0 | 93.0 | 93.0 | 93.0 |
| Additive | | | | | | | | | | |
| $Na_2S_2O_3$ | 3.0 | 3.0 | | | | | | 1.0 | | 2.0 |

TABLE 5-continued

| Example | 41 | 42 | 43 | 44 | 45 | 46 | 47 | 48 | 49 | 50 |
|---|---|---|---|---|---|---|---|---|---|---|
| $Na_2S_2O_3.5H_2O$ | | | 3.0 | 3.0 | | | 3.0 | | 2.0 | |
| Desilube 88 *1 | | | | | 3.0 | 3.0 | | 2.0 | 1.0 | 1.0 |
| SAP001 *2 | 2.0 | | | | | 2.0 | | 1.0 | | |
| SAP007 *3 | | 2.0 | | | | | 1.0 | | 2.0 | 1.0 |
| OLOA219 *4 | | | 2.0 | | 1.0 | | 1.0 | | | 1.0 |
| NA-SUL 729 *5 | | | | 2.0 | 1.0 | | | 1.0 | | |
| BT-120 *6 | 2.0 | 2.0 | 2.0 | 2.0 | 2.0 | 2.0 | 2.0 | 2.0 | 2.0 | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | A | A | A | A | A | A | A | A | A |
| Four-ball test | | | | | | | | | | |
| Expansion load, N | 3922 | 3922 | 3089 | 3089 | 3922 | 3922 | 3089 | 3922 | 3922 | 3922 |
| Abrasion mark diameter, mm | 0.73 | 0.71 | 0.72 | 0.68 | 0.70 | 0.73 | 0.70 | 0.67 | 0.72 | 0.71 |

TABLE 6

| Comparative Example | 1 | 2 | 3 | 4 | 5 | 6 | 7 | 8 | 9 | 10 |
|---|---|---|---|---|---|---|---|---|---|---|
| Composition, % by weight | | | | | | | | | | |
| Base Grease | | | | | | | | | | |
| Urea Grease | 100.0 | 97.0 | 97.0 | 97.0 | 93.0 | 93.0 | 93.0 | 93.0 | 93.0 | 93.0 |
| Additive | | | | | | | | | | |
| $Na_2S_2O_3$ | | 3.0 | | | 3.0 | 2.0 | 3.0 | | | |
| $Na_2S_2O_3.5H_2O$ | | | 3.0 | | | 1.0 | | 3.0 | | 2.0 |
| Desilube 88 *1 | | | | 3.0 | | | | | 3.0 | 1.0 |
| NA-SUL ZS *7 | | | | | 4.0 | | | | | |
| Dailube Z-500 *8 | | | | | | 4.0 | | | 2.0 | |
| NA-SUL SS *9 | | | | | | | 4.0 | | 2.0 | 2.0 |
| NA-SUL 707 *10 | | | | | | | | 4.0 | | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | E | E | E | E | E | E | E | E | E |
| Four-ball test | | | | | | | | | | |
| Expansion load, N | 1570 | 7845 | 6080 | 7845 | 7845 | 7845 | 7845 | 6080 | 7845 | 7845 |
| Abrasion mark diameter, mm | 0.88 | 0.68 | 0.72 | 0.68 | 0.72 | 0.78 | 0.89 | 0.84 | 0.81 | 0.87 |

TABLE 7

| Comparative Example | 11 | 12 | 13 | 14 | 15 | 18 | 17 | 18 | 19 | 20 |
|---|---|---|---|---|---|---|---|---|---|---|
| Composition, % by weight | | | | | | | | | | |
| Base Grease | | | | | | | | | | |
| Lithium Soap Grease | 100.0 | 97.0 | 97.0 | 97.0 | 93.0 | 93.0 | 93.0 | 93.0 | 93.0 | 93.0 |
| Additive | | | | | | | | | | |
| $Na_2S_2O_3$ | | 3.0 | | | 3.0 | 2.0 | 3.0 | | | |
| $Na_2S_2O_3.5H_2O$ | | | 3.0 | | | 1.0 | | 3.0 | | 2.0 |
| Desilube 88 *1 | | | | 3.0 | | | | | 3.0 | 1.0 |
| NA-SUL ZS *7 | | | | | 4.0 | | | | | |
| Dailube Z-500 *8 | | | | | | 4.0 | | | 2.0 | |

TABLE 7-continued

| Comparative Example | 11 | 12 | 13 | 14 | 15 | 18 | 17 | 18 | 19 | 20 |
|---|---|---|---|---|---|---|---|---|---|---|
| NA-SUL SS *9 | | | | | | | 4.0 | | 2.0 | 2.0 |
| NA-SUL 707 *10 | | | | | | | | 4.0 | | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | E | E | E | E | E | E | E | E | E |
| Four-ball test | | | | | | | | | | |
| Expansion load, N | 1236 | 6080 | 4903 | 6080 | 6080 | 6080 | 6080 | 4903 | 6080 | 6080 |
| Abrasion mark diameter, mm | 0.93 | 0.74 | 0.72 | 0.69 | 0.71 | 0.70 | 0.69 | 0.68 | 0.74 | 0.66 |

TABLE 8

| Comparative Example | 21 | 22 | 23 | 24 | 25 | 26 | 27 | 28 | 29 | 30 |
|---|---|---|---|---|---|---|---|---|---|---|
| Composition, % by weight | | | | | | | | | | |
| Base Grease | | | | | | | | | | |
| Lithium Complex Soap Grease | 100.0 | 97.0 | 97.0 | 97.0 | 93.0 | 93.0 | 93.0 | 93.0 | 93.0 | 93.0 |
| Additive | | | | | | | | | | |
| $Na_2S_2O_3$ | | 3.0 | | | 3.0 | 2.0 | 3.0 | | | |
| $Na_2S_2O_3.5H_2O$ | | | 3.0 | | | 1.0 | | 3.0 | | 2.0 |
| Desilube 88 *1 | | | | 3.0 | | | | | 3.0 | 1.0 |
| NA-SUL ZS *7 | | | | | 4.0 | | | | | |
| Dailube Z-500 *8 | | | | | | 4.0 | | | 2.0 | |
| NA-SUL SS *9 | | | | | | | 4.0 | | 2.0 | 2.0 |
| NA-SUL 707 *10 | | | | | | | | 4.0 | | 2.0 |
| Total | 100 | 100 | 100 | 100 | 100 | 100 | 100 | 100 | 100 | 100 |
| Test Results | | | | | | | | | | |
| Rust prevention test | | | | | | | | | | |
| Humidity test | A | E | E | E | E | E | E | E | E | E |
| Four-ball test | | | | | | | | | | |
| Expansion load, N | 1570 | 6080 | 6080 | 6080 | 6080 | 6080 | 6080 | 6080 | 6080 | 6080 |
| Abrasion mark diameter, mm | 0.79 | 0.78 | 0.77 | 0.76 | 0.78 | 0.76 | 0.65 | 0.79 | 0.71 | 0.69 |

TABLE 9

| Comparative Example | 31 | 32 | 33 | 34 | 35 | 36 | 37 | 38 | 39 | 40 |
|---|---|---|---|---|---|---|---|---|---|---|
| Composition, % by weight | | | | | | | | | | |
| Base Grease | | | | | | | | | | |
| Aluminium Complex Soap Grease | 100.0 | 97.0 | 97.0 | 97.0 | 93.0 | 93.0 | 93.0 | 93.0 | 93.0 | 93.0 |
| Additive | | | | | | | | | | |
| $Na_2S_2O_3$ | | 3.0 | | | 3.0 | 2.0 | 3.0 | | | |
| $Na_2S_2O_3.5H_2O$ | | | 3.0 | | | 1.0 | | 3.0 | | 2.0 |
| Desilube 88 *1 | | | | 3.0 | | | | | 3.0 | 1.0 |
| NA-SUL ZS *7 | | | | | 4.0 | | | | | |
| Dailube Z-500 *8 | | | | | | 4.0 | | | 2.0 | |
| NA-SUL SS *9 | | | | | | | 4.0 | | 2.0 | 2.0 |
| NA-SUL 707 *10 | | | | | | | | 4.0 | | 2.0 |
| Total | 100 | 100 | 100 | 100 | 100 | 100 | 100 | 100 | 100 | 100 |

TABLE 9-continued

| Comparative Example | 31 | 32 | 33 | 34 | 35 | 36 | 37 | 38 | 39 | 40 |
|---|---|---|---|---|---|---|---|---|---|---|
| Test Results | | | | | | | | | | |
| Rust prevention test | | | | | | | | | | |
| Humidity test | A | E | E | E | E | E | E | E | E | E |
| Four-ball test | | | | | | | | | | |
| Expansion load, N | 1570 | 3089 | 3089 | 3922 | 3922 | 3922 | 3922 | 3089 | 3922 | 3922 |
| Abrasion mark diameter, mm | 0.98 | 0.71 | 0.70 | 0.69 | 0.72 | 0.72 | 0.76 | 0.81 | 0.70 | 0.84 |

Effects of the Invention

As is clear from the Examples in Tables 1 to 5 and the Comparative Examples in Tables 6 to 9, the grease compositions according to the invention in which the aforementioned additives (A) are added to grease compositions into which sodium thiosulphate has been compounded have excellent extreme pressure properties and their rust prevention performance is greatly increased. Grease compositions in which the aforementioned additives (A) and the aforementioned benzotriazole compounds (B) are added to greases into which sodium thiosulphate has been compounded also have excellent extreme pressure and rust prevention properties and additionally have excellent abrasion resistance. The increase in abrasion resistance is particularly marked in urea greases, lithium soap greases and lithium complex soap greases. Sodium thiosulphate has been recognised for a long time as a foodstuff additive and, since it is also known as a detoxifying agent, it is an additive which is not only gentle on the human body, but also on the global environment. The compositions according to the invention are therefore excellent greases which are compatible with the environment.

What is claimed is:

1. A grease composition comprising a base oil and a thickener, which grease additionally comprises from 0.05% to 30% by weight of sodium thiosulphate; and, at least 0.1% by weight of at least one additives selected from the group of: calcium salicylate, magnesium salicylate, calcium phenate and/or alcium sulphonate, based on the total grease composition.

2. The grease composition of claim 1, wherein said at least one additives are each present in an amount in the range of from 0.1% to 5% by weight, based on the total grease composition.

3. The grease composition of claim 1, wherein said at least one additives are each present in an amount in the range of from 0.2% to 3% by weight, based on the total grease composition.

4. The grease composition of claim 1, wherein said composition further comprises at least 0.1% by weight of a benzotriazole compound, based on the total grease composition.

5. The grease composition of claim 4, wherein said benzotriazole compound is present in an amount in the range of from 0.1% to 5% by weight, based on the total grease composition.

6. The grease composition of claim 4, wherein said benzotriazole compound is present in an amount in the range of from 0.2% to 3% by weight, based on the total grease composition.

7. The grease composition of claim 4, wherein said benzotriazole compound is selected from the group consisting of: 1,2,3-benzotriazole, 2-(2'-hydroxy-5'-methylphenyl) benzotriazole, 2-[2'-hydroxy-3'-(3", 4", 5", 6"-tetrahydrophthalimidomethyl)-5'-methylphenyl] benzotriazole, 2-(2'-hydroxy-3',5 '-di-tertiary-butylphenyl) benzotriazole, 2-(2'-hydroxy-5'-tertiary-octylphenyl) benzotriazole, 2-(2'-hydroxy-3',5'-di-tertiary-amylphenyl) benzotriazole,2-[2-hydroxy-3,5-bis(α,α-dimethylbenzyl) phenyl]-2H-benzotriazole and 2-(2'-hydroxy-3'-undecyl-5'-methylphenyl)benzotriazole.

8. The grease composition of claim 1, wherein the thickener is at lease one urea compounds, at least one lithium soaps and lithium complex soaps, and at least one aluminium complex soaps.

9. A method of preparing a grease composition comprising a base oil and a thickener, which grease additionally comprises from 0.05% to 30% by weight of sodium thiosulphate; and, at least 0.1% by weight of at least one additive is selected from the group of: calcium salicylate, magnesium salicylate, calcium phenate and/or calcium sulphonate, based on the total grease composition, wherein said method comprises pre-mixing sodium thiosulphate and at least one additive is selected from the group of: calcium salicylate, magnesium salicylate, calcium phenate and calcium sulphonate, and, adding the mixture to base grease comprising base oil and thickener, or wherein sodium thiosulphate and at least one additive is incorporated individually into said base grease.

* * * * *